United States Patent [19]

Desjardins et al.

[11] Patent Number: 4,973,432

[45] Date of Patent: Nov. 27, 1990

[54] AERATION HEADER MODULE

[75] Inventors: Gaétan Desjardins, Ville d'Anjou; Louis Obidniak, Duvernay; Pierre Lariviere, Roxton Falls, all of Canada

[73] Assignee: ECO Equipement FEP Inc., Montreal, Canada

[21] Appl. No.: 414,676

[22] Filed: Sep. 29, 1989

Related U.S. Application Data

[63] Continuation-in-part of Ser. No. 278,219, Nov. 30, 1988, abandoned.

[51] Int. Cl.[5] ..... B01F 3/04

[52] U.S. Cl. ..... 261/76; 261/DIG. 75; 239/416.5; 239/418

[58] Field of Search ..... 210/150, 151, 220, 170; 261/76, DIG. 75; 239/416.5, 418

[56] References Cited

U.S. PATENT DOCUMENTS

| | | | |
|---|---|---|---|
| 3,946,449 | 3/1976 | Mathis | 4/178 |
| 4,112,025 | 9/1978 | Wilson et al. | 261/29 |
| 4,335,854 | 6/1982 | Reynoso | 239/428.5 |
| 4,542,854 | 9/1985 | Mathis | 239/587 |
| 4,586,204 | 5/1986 | Daniels | 4/542 |
| 4,593,420 | 6/1986 | Tobias et al. | 4/496 |
| 4,618,426 | 10/1986 | Mandt | 210/620 |
| 4,689,839 | 9/1987 | Henkin et al. | 239/416.5 |
| 4,857,185 | 8/1989 | Desjardins | 210/150 |

*Primary Examiner*—W. Gary Jones

*Assistant Examiner*—Cynthia L. Nessler

*Attorney, Agent, or Firm*—Eckert Seamans Cherin & Mellott

[57] ABSTRACT

A jet aeration header is disclosed, for use in water and wastewater process and treatment system. The header comprises a first pipe defining a cylindrical water passage, a second pipe extending parallel to the first pipe and defining a cylindrical air passage, at least one water outlet conduit connected to the first pipe to allow water to be expelled out of the water passage, an air-feed pipe connecting the second pipe to the outlet conduit to allow air to be delivered from the air passage to the water flowing through this conduit, and a venturi cone mounted in the outlet conduit to allow air to be FED from the air passage and be mixed with a water expelled through the outlet conduit. This basic structure is improved in that each outlet conduit is connected to the first pipe by a hollow nipple laterally projecting from the first pipe, the nipple having a large, flared inlet solidly connected to the first pipe in such a manner that no sharp edges or protrusions are left inside the water passage, that would favor fibrous materials to attach, accumulate and clog the outlet conduit. Each water outlet conduit is defined by the transverse bar section of a T-shaped pipe, the stem section of the T-shaped pipe being connected to the air-feed pipe. The venturi cone is mounted into the transverse bar section of the T-shaped pipe forming the conduit outlet so that the wide inlet of the venturi cone is adjacent the outlet of the nipple to which the T-shaped pipe is connected.

8 Claims, 3 Drawing Sheets

AERATION HEADER MODULE

CROSS REFERENCE TO RELATED APPLICATION

This is a continuation-in-part of pending patent application Ser. No. 278,219, filed Nov. 30, 1988 now abandoned.

BACKGROUND OF THE INVENTION

1. Field of the invention

The present invention relates to the construction of jet headers for use in a system for aeration and/or mixing of water in basin or lagoon, and more particularly to a jet header of improved construction for use in such a system.

The term "wastewater" as used hereinafter, is intended to include any water of domestic, commercial and industrial origin. Other types of liquid mixtures may also be treated by such a system.

2. Brief description of the prior art

There are presently three types of jet aeration/mixing systems that are used industrially.

The first system which may be said to be of the "self-suction" type, includes jets that are so designed as to draw air or another gas at atmospheric pressure without any means of pressurization other than the dynamic pressure of the wastewater flowing through a pipe. In this system, the waterwater passes into a long venturi tube that is open to air, and is expelled as a jet containing air bubbles at the discharge end of the tube.

The second system includes jets fed by air or another gas under pressure, and by water under pressure. In this second system, the wastewater flows through a short venturi tube connected to a supply of air under pressure.

The third system include a jet designed to mix the content of a liquid tank, the liquid in the tank being used as motive pressure to feed the jet. A secondary fluid in gas or liquid form can be injected into the jet depending on the kind of mixing desired in the tank and whether or not a chemical reaction is also to take place such as, for example, neutralization, system equalization, floculation, etc.).

All of these types of jet aeration systems are supplied by a common source of pressurized wastewater flowing in a plenum water pipe, also called water header.

The above first two types of systems may utilize a common source of air flowing in a plenum air pipe, also called air header, if individual air intakes cannot be connected directly from the water surface to the venturi tube, for such reasons as ice protection, aesthetics, or life expectancy of the equipment. If there are no such reasons, then individual air intakes may be used, thereby making the resulting structure much simpler. This simplification is particularly advantageous with the jet aeration system of the self-suction type. In fact, the air supply can then be reduced to an individual short intake having a very small diameter, thereby avoiding the necessity of an air header running parallel to the wastewater header. In such cases, the only header necessary is therefore the water header which can be installed parallel to the water surface in the basin and very close to the water level. The elevation of this water header can vary indefinitely from deep submergence up to above the water surface.

Canadian patent application No. 561,448 filed on Mar. 15, 1988 and its counterpart U.S. Ser. No. 170,742 filed Mar. 21, 1988, now U.S. Pat. No. 4,857,185, both in the name of Gaetan Desjardins, disclose a system for the treatment of wastewater, comprising a combined air and wastewater header assembly extending across a basin. This assembly may be described as a group of pipings provided with means creating aerated water jets discharging into the basin and causing circulation of the wastewater in an endless path in this basin while simultaneously aerating it. A dam is formed across the path to allow sludges to settle at the bottom of the basin. A pumping station, built into a well, is used to feed the wastewater header with water drawn from the top of the body of wastewater in the basin; to aerate the water as it is discharged into the basin; to draw out sludges that have accumulated upstream of the dam; and generally to circulate water to clean the pipings whenever necessary.

It is well known by those skilled in the above summarized art that the construction of a jet aeration header like the one used in the system disclosed in the above identified patent applications or in any other wastewater aeration systems of the same type is time-consuming and therefore expensive.

Indeed, the construction of such a jet header requires the attachment and operative connection of at least one laterally extending, wastewater outlet conduit onto a pressurized wastewater pipe to produce a water jet flowing concentrically through a long or short venturi cone where it is subsequently mixed with air to form a mixture of water and gas bubbles that may be energically discharged into the basin.

Of course, this connection must be hydraulically efficient, so that the outlet conduit and its connection to the wastewater pipe have controlled internal surfaces in order to achieve trouble-free operation.

This major constructional requirement is usually achieved by using piping components made of fiberglass-reinforced plastic material (F.R.P.) because of the recognized properties in terms of molding characteristics, smoothness and corrosion resistance of this material.

Because the construction of such a jet header necessitates intensive manual work, the quality of the resulting headers may vary substantially from one another.

More over, it is known that any F.R.P. material consisting of fibers glued together by resin is difficult to work with. This problem is so well known that in most the industrialized government agencies have enacted specific F.R.P. construction standards to ensure a minimum quality level. In North America, these Standards are as follows:

Canadian Standard for F.R.P. corrosion resistant equipment # CGSB 41GP22 rev./84.

National Bureau of Standards of the United States # PS15-69.

For different reasons (mainly construction costs, difficulties in adapting the jet header construction to the above Standards etc . . . ), no jet aeration header presently available on the market today can easily meet those well established constructional requirements. To better respect these fabrication standards idealy each piece must be moulded to specification in one piece.

After these pieces are so moulded, no alteration should be permitted on these pieces. Only standard assembly should be allowed without altering the structure of these pieces by cutting or drilling through them.

One of the competitor construction methods presently used to connect wastewater outlet conduits to a main wastewater pipe consists in drilling large orifices on an existing F.R.P. pipe and fixing the outlet conduits onto these orifices. The main drawback of this method is that the F.R.P. pipe structure is seriously altered where its fibers are cut. As a result, the pipe cannot readily meet the construction requirements of the above mentioned Standards even if layers of reinforcing fibers are locally added around the conduits at their connections to the main pipe.

Another method that is presently used, consists in manufacturing directly the header by winding fibers around a mandrel on which prefabricated outlet conduits (i.e. jets) are already positioned to simultaneously form the pipe and outlet conduits projecting therefrom. In this method, the angle of orientation of the fibers is necessarily altered all around the jets and on pipe itself. As a result, the header which is so obtained does not and cannot meet one of the major requirements of the above Standards. According to this major requirement, the fiber winding angle must be kept uniform all along the pipe at a value of 55°±2 degrees. The degree of orientation may varies for some construction but it must always remain constant within ±2 degrees maximum.

Thus, the above methods present two major construction deficiencies that are presently not overcome by any North American manufacturers. Indeed, the first method calls for a structural modification of a premolded F.R.P. pipe which is composed of fibers glued together with resin and has to be drilled to fix the jets. Of course, the portions of the pipe surrounding the jets may be reinforced but the resulting structure is almost impossible to be calculated as such. Moreover, it is presently very hard to perfectly position the jet inlets in front of the drilled holes and almost impossible to finish the internal surfaces of the connections to make them ultra smooth.

Presently, in spite of the recognized importance of quality control for this type of construction, no manufacturer can internally inspect the presently existing F.R.P. jet header. Such an inspection is impossible because of the size of the main pipe that is normally too small for anyone to crawl into. Yet, such a physical inspection is very important to ensure that any manual work is performed properly with no sharp edges or protusions on all internal surfaces and particularly at the jet connections. However, the possibility of a complete inspection is of the utmost importance in order to control clogging problems associated with poor jet connection construction. Indeed, if any pipe intersection is not matched and finished perfectly, sharp edges are left, to which fibers included into the wastewater will rapidly attach, thereby accumulating and pretty soon clogging the jet. Thus, any sharp edges will favor fibrous material to attach, accumulate and clog the jets.

Moreover, the second method mentioned hereinabove leads to pipes that do not meet the requirements of the above Standard with respect to the angle of orientation of the fibers, in addition to having the same disadvantages as the first method with respect to finishing and inspection of the resulting structure.

SUMMARY OF THE INVENTION

An object of the present invention is to provide an improved jet header for use in any of the three water aeration/mixing systems mentioned hereinabove, which header is suitable to be factory made at low cost and easy to connect to existing water and air pipes, in situ, to thus reduce the installation costs, it being undestood that the header can also be "shop-connected" prior to shipment.

Another object of the invention is to provide an improved jet header whose construction and structure comply with the true spirit all of the construction Standards. More specifically, the other object of the invention is to provide a jet aeration/mixing header where the conduit outlet(s) acting as "jets" are attached to an F.R.P. pipe in such an efficient way that the resulting structure readily meets all the requirements of the above mentioned 41GP22 or PS15-69 Standards with special inspection, difficult procedure and testings.

A further object of the invention is to provide an improved jet aeration/mixing header which is much less subjected to clogging than the existing one, and is able to operate with slightly lower head loss due to special long neck connector pieces premolded to 3" radius (herecalled flared nipples). These 3" radius nipples also allow the lowest possible hydraulic head loss at high water velocity because it avoids any water detachement layer at the nipple wall. So these special long radius nipples allows the lowest possible K value for sudden contraction hydraulic calculation. So more flow is supplied for the same energy for superior oxygen transfer performances.

The jet header according to the invention which is especially designed for use in a water or wastewater treatment system, basically comprises:

a first pipe defining a cylindrical water passage, a second pipe extending parallel to the first pipe and defining a cylindrical air passage;

at least one water outlet conduit connected to the first pipe and laterally extending therefrom to allow water to be expelled out of the water passage;

at least one air-feed pipe, each air-feed pipe connecting the second pipe to one outlet conduit at a given point of connection along this outlet conduit to allow air to be delivered from the air passage into the water flowing through this outlet conduit; and a venturi cone mounted in each outlet conduit, this cone having a wide inlet extending across the outlet conduit upstream the point of connection of the air-feed pipe, and a narrow outlet extending centrally in the outlet conduit downstream this point of connection to allow, in use, air to be drawn or FED from the air passage and be mixed with the water expelled through the narrow outlet of the cone.

In accordance with the invention, this basic structure which is known per se is improved in that the first pipe is provided with at least one hollow, long radius nipple laterally projecting therefrom, each nipple having a large, flared inlet that opens into said water passage, and a small outlet for use to connect one of the water outlet conduit(s). Thanks to its inlet being wide and flared, each nipple is connected to the first with no sharp edges or protusions left inside the water passage that would favor fibrous materials to attach, accumulate and clog the nipple inlet.

In accordance with the invention, each water outlet conduit is also defined by a T-shaped pipe having a stem section and a transverse bar section being connected at one end to the small outlet of one nipple to form a corresponding outlet conduit, with the stem section acting as point of connection for the air-feed pipe connected to this outlet conduit. Moreover, the wide inlet of each venturi cone has an internal diameter identical to the one of the small outlet of the nipple adjacent thereto, and each venturi cone is mounted into the transverse bar of the T-shaped pipe forming the conduit outlet so that the wide inlet of the venturi cone is adjacent to the small outlet of the nipple to which the conduit outlet is connected.

Whenever desired, a nozzle may be connected to each transverse bar section forming a conduit outlet, opposite to the one end of the transverse bar section connected to the nipple. Advantageously, the nozzle has an inlet having an internal diameter identical to the one of the transverse bar section, and an outlet of smaller diameter.

The above structural elements may be easily connected to each other by means of sockets integral to their structure. With such sockets, all of these elements may be easily fitted one inside the other.

In accordance with a first preferred embodiment of the invention, the first pipe has a plurality of nipples solid thereto and a plurality of water outlet conduits and air-feed pipes connected to these nipples. In this embodiment, the first pipe, the nipples solid thereto pipe and the second pipe are preferably made of fiber reinforced plastic material whereas all the other structural elements of the header are made of injected plastic material, such as polyurethane. In this embodiment, the nipples are also sized wide enough to allow insertion of at least one hand therein through their small outlets in order to give easy access to the first pipe through the nipples and thus allow a worker to perfectly finish the critical nipple-to-first pipe interconnection and/or to physically inspect the same.

In accordance with another preferred embodiment of the invention a unitaire complete jet module is provided for assembly to a standard, non-altered F.R.P. pipe. In this embodiment, the first pipe is short in length and has a single nipple solid thereto and a single conduit outlet connected to this single nipple. The first pipe also has ends provided with sockets sized to receive and fit over straight lengths of wastewater pipes. In this embodiment, the second pipe is also short in length and also has ends provided with sockets sized to receive and fit over straight lengths of air pipes.

The first pipe, the single nipple solid thereto and the second pipe are also made in one piece fiber reinforced plastic material whereas all the other structural elements of the header are made of injected plastic material.

The jet aeration/mixing header according to the invention as briefly summarized hereinabove has the following advantages.

First of all, it permits proper internal and external quality control inspection of its structure before its assembly to top quality F.R.P. pipes.

When the header is in the form of a single air jet module, it allows the use of standard F.R.P. pipes meeting the true spirit of all constructional requirements dictated by 41GP22 and PS15-69. No alteration of these pipes is necessary. As a rule, pipes can be fabricated from one of the two methods allowed, e.g. filament-wound type or manual hand lay-up construction.

It allows the wastewater jet to be centered very concentrically within the venturi cone(s) thanks to the socket-molded nipple(s) that are designed to receive the transverse bar section of the T-shaped pipe(s) acting as wastewater outlet conduit.

It allows to proceed with piping size reduction for the water and air pipes. Reducer fittings can readily be built up with the socket connections provided in on each side of the module.

It provides truly concentric alignment and reliable geometric positioning for all the elements thanks to their molded end sockets.

It provides better quality construction of all the components of the header, readily complying with the 41GP22 and PS15-69 construction standards. More important, it provides jet headers that comply with the same standards of construction as a finished product as well as individual components.

It allows the jet aeration header to be assembled near the job site and/or on the job site itself if desirable. In fact, when the header is in the form of modules, it can be shipped on the job site and be socket-assembled there with standard F.R.P. pipes.

In practice, the jet aeration header module according to the first embodiment of the invention can be manufactured as follows.

In a first step, F.R.P. pipes intended to be used as first and second pipes for wastewater and air supplies are drilled with extra large orifices of from 6" to 9" in diameter. In a second step, premoulded flared nipples are applied onto the orifices and glued by lamination to the pipes. Because these orifices and the nipples are quite large, it becomes possible for someone to physically insert one of his hands with a finishing tool inside the pipes in order to internally finish the interconnection and eliminate completely sharp edges and protusions. The size of these orifices and nipples also makes it possible to inspect this critical part of the work prior to installing the polyurethane jet assembly between the air and water nipples. In a third and last step, the other elements (the polyurethane jet assembly e.g. T-shaped pipe, air-feed pipe, venturi cone and nozzle) are then assembled by mere fitting of their socketed ends onto the nipples and/or each other.

The jet aeration header according to the second embodiment of the invention can be manufactured as follows.

In a first step, the first and second pipes are premolded on a short mandrel equipped with caps at both ends in order to form integral sockets at both ends of the pipes to facilitate their assembly and alignment onto standard lengths of pipes. All water pipes are molded with a smooth, 3" radius flared nipple extending radially therefrom. In a second step, the other elements are assembled by fitting their socketed ends onto the nipples.

In both cases, the manufacture and/or connection of the F.R.P. elements is basically done by contact molding using a manual lay-up construction method. All critical connections can be inspected and finished immediately and each of the elements can be finally assembled together to form a complete jet aeration modular header truly complying with the 41GP22 and PS15-69 construction standards. The header that is so formed is then ready to be connected with non-altered, standard approved F.R.P. pipes. Provided that all the connections to these pipes are performed with the same quality standard, the resulting jet aeration modular header also truly complies with the 41GP22 and PS15-69 standards as a finished product without calling for any special mandatory inspection, procedure and testing because no element has been altered once it has been moulded.

BRIEF DESCRIPTION OF THE DRAWINGS

The invention will be better understood upon reading of the following non-restrictive description of two preferred embodiments thereof, given with reference to the accompanying drawings in which.

DESCRIPTION OF TWO PREFERRED EMBODIMENTS

In the following description, reference will only be made to the treatment of wastewater. It is worth mentioning however that the invention also applies to the treatment of water and other aqueous solutions.

Figure 1:
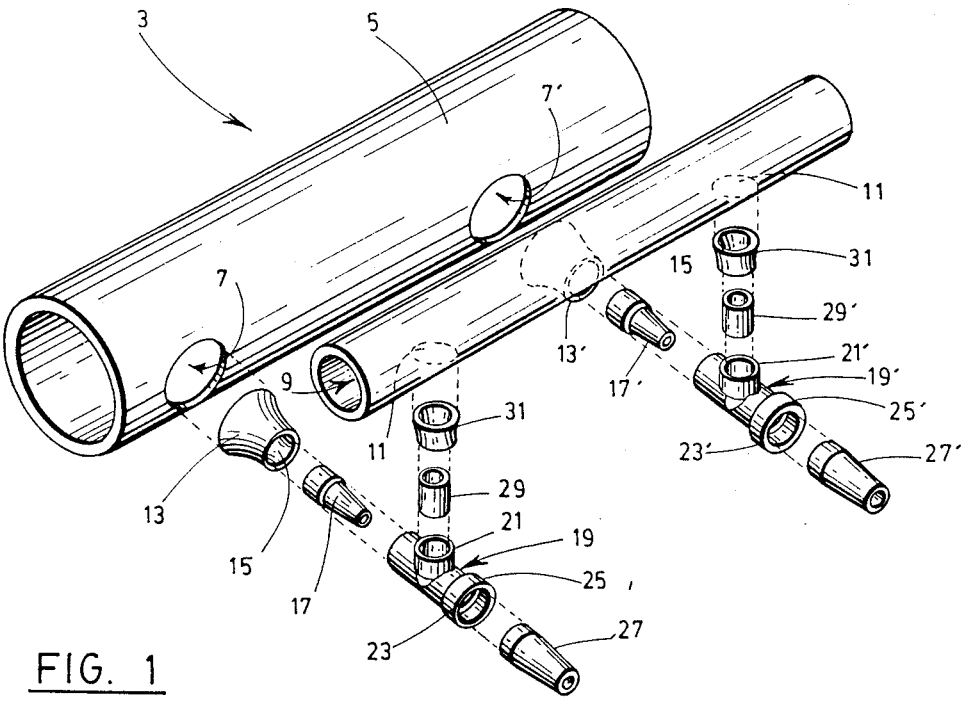
FIG. 1 is an exploded, perspective view of a jet aeration header according to a first embodiment of the invention.
Figure 2:
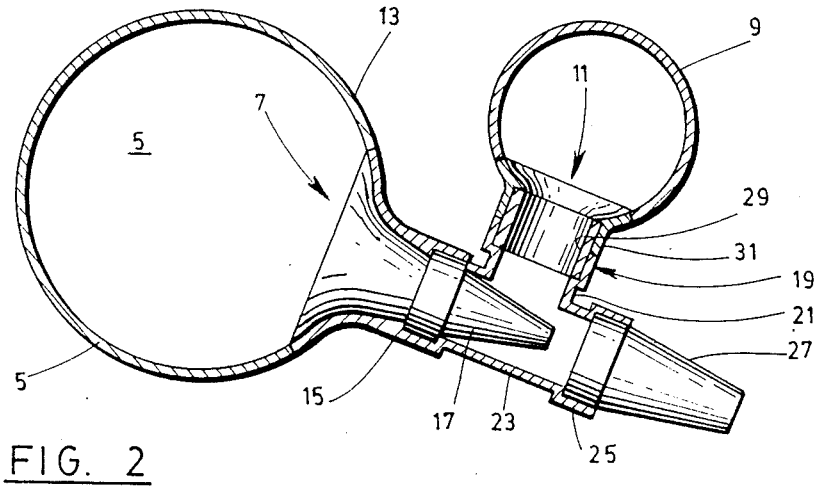
FIG. 2 is a side elevational, cross sectional view of the header shown in FIG. 1, in assembled position.

The jet aeration header 3 according to the first embodiment of the invention as shown in FIGS. 1 and 2, comprises a first cylindrical pipe 5 which defines a wastewater passage 5'. This pipe 5 is provided with a plurality of large orifices 7, 7', typically 8" wide, drilled through its wall.

The header 3 also comprises a second cylindrical pipe 9 also having large orifices 11, 11' drilled therethrough at the same interval as the orifices 7, 7'.

The header 3 further comprises a set of large nipples 13, 13' having a large, 3" radius flared inlet intended to be solidly connected to the pipe 5. Each nipple 13, 13' is applied onto a corresponding orifices 7, 7' and glued on the edges of the same for connection to the pipe 5. Layers of reinforcing fibers may be applied over this connection which is designed to allow necessary inspection.

Advantageously, the small outlet of each nipple 13, 13' is wide enough (for example 4" wide) to allow someone to insert his hand therethrough in order to reach the joint between the large inlet and the edge of the opening 7, 7' inside the pipe 5 to perfectly finish the interior surface of the same and make it sure that no sharp edges or protusions are left inside the wastewater passage 5', that would favor fibrous materials to attach, accumulate and clog the nipple inlet.

Advantageously, the small outlet of the nipple 13, 13' may be extended by a socket 15, 15' sized to receive the wide inlet of a venturi cone 17, 17' made of polyurethane or any similar material.

To reduce as much as possible the presence of sharp edges and protusions, the wide inlet of the venturi cone 17, 17' has an internal diameter identical to the one of the small outlet of the nipple 13, 13'. This particular structure and its advantages is clearly shown in FIG. 2.

The header 3 further comprises a set of T-shaped pipes 19, 19', each comprising a stem section 21, 21' and a transverse bar section 23, 23' which acts as a wastewater outlet conduit and is inserted over the cone 17, 17' into the socket 15, 15' of the nipples 13, 13'. As clearly shown in FIG. 2, the venturi cone 17, 17' is long enough to extend from the inlet of the transverse bar section 23, 23' downstream the stem section 21, 21'.

The other end of the transverse bar section 23, 23' is integrally extended by a socket 25, 25' sized to receive the inlet of a nozzle 27, 27'. Once again, to reduce as much as possible the risk of clogging, the internal diameter of the inlet of the nozzle 27, 27' is substantially identical to the internal diameter of the transverse bar section 23, 23' to provide a smooth and continuous passage to the wastewater flowing through the conduit. The T-shaped pipes 19, 19' as well as the nozzles 27, 27' may be made of injected plastic material, like polyurethane.

An air-feed pipe 29, 29' is provided for connecting the second pipe 9 to the wastewater outlet conduit defined by the transverse bar section 23, 23' of the T-shaped pipes 19, 19', in such a manner as to allow air to be drawn from the air passage 9' and be delivered into the outlet conduit for mixing with the wastewater flowing out of the wastewater passage 5'. The air-feed pipe 29, 29' is in the shape of a small length of pipe having one end inserted into a socket integrally molded for this purpose at the free end of the stem section 21, 21'' of the T-shaped pipes 19, 19' which, thus, acts as a point of connection for the air-feed pipe. The other end of the air-feed pipe 29, 29' is connected to another nipple 31, 31' rigidly mounted over the orifices 11, 11' of the second pipe 9.

In use, the venturi cone 17, 17' which extends inside the transverse bar section 23, 23, of the T-shaped pipe 19, 19' past the point of connection of the air-feed pipes 29, 29' defined by the stem section 21, 21' of the pipe 19, 19', causes the wastewater flowing therethrough under pressure from the passage 5' to allow air to be drawn or FED from the passage 9' via the air-feed pipe 29, 29', so that this air is mixed with the wastewater prior to be expelled out through the nozzle 29, 29'.

Figure 3:
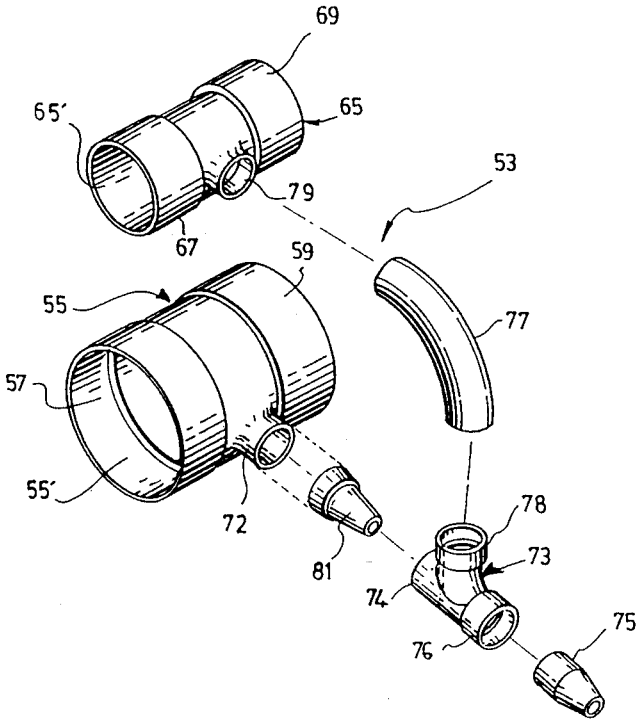
FIG. 3 is an exploded perspective view of a jet aeration header according to a second embodiment of the invention, which header is in the form of a module.
Figure 4:
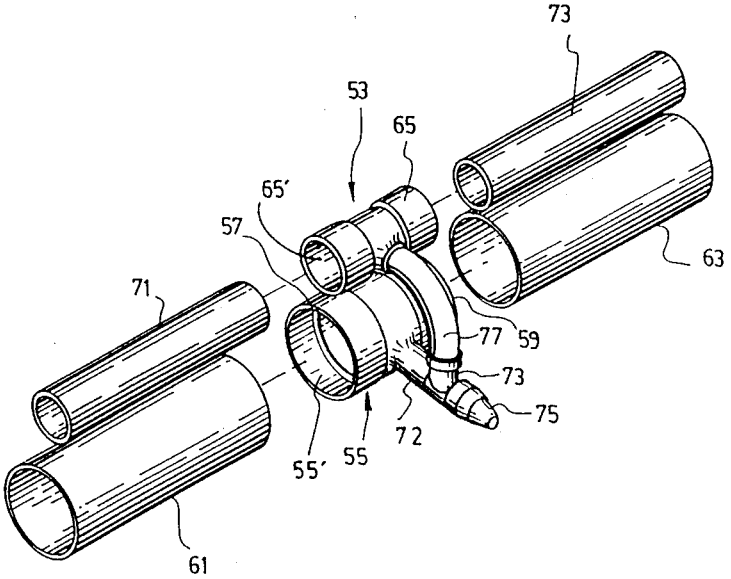
FIG. 4 is an exploded, perspective of a jet aeration system incorporating a header module as shown in FIG. 3.

The jet aeration header 53 according to the second embodiment of the invention as shown in FIGS. 3 and 4, is in the form of a module. It comprises a first cylindrical pipe 55 which defines a wastewater passage 55'. This first pipe has end sockets 57, 59 sized to receive and fit over the ends of lengths of wastewater pipes 61, 63. The header 53 also comprises a second cylindrical pipe 65 having end sockets 67, 69 sized to receive and fit over length of air pipes 71, 73. This second pipe 65 defines an air passage 65'. The header 53 further comprises a large nipple 72 having a large, flared inlet solid with the first cylinder 55 and a small outlet extending radically away from this first cylinder.

A T-shaped pipe 73 having a stem section 78 and a transverse bar section is fixed onto the nipple 72 by insertion of one end 74 of its transverse bar section directly onto the nipple. In such a position, the transverse bar acts as a wastewater outlet conduit through which wastewater entering the nipple may escape. The transverse bar section has its other end 76 which is socketed and sized to receive a nozzle 75 whose inlet has an internal diameter identical to the one of the socketed end 76 of the T-shaped pipe 73, and an outlet of smaller diameter.

An air-feed pipe 77 is provided for connecting the second pipe 65 to the wastewater outlet conduit defined by the transverse bar section of the T-shaped pipe 73 in such a manner as to allow air to be drawn or fed from the air passage 65' and be delivered into the outlet conduit for mixing with the wastewater flowing out of the wastewater passage 55'. The air-feed pipe 77 which is in the shape of a small arcuate cylinder, joins the free end 78 of the stem section of the T-shaped pipe 73 to another nipple 79 that may be provided on the second cylinder 65.

The air pipe 77 can be replaced by the short pipe 9 where air pipes 71,73 are mounted as per FIG. 1, 2, e.g. right on top of the T-shape pipe 73.

The header 55 finally comprises a venturi cone 81 mounted at the outlet of the nipple 72. The wide base of the cone which acts as inlet, has an internal diameter which is identical to the one of the nipple 72 and is mounted adjacent the same so that the outlet of the nipple be extended by inlet of the cone. The venturi cone 81 extends inside the transverse bar section of the T-shaped pipe 73 past the point of connection of the air-feed pipe 77, which point is defined by the stem section of the pipe 73. In this manner and according to the venturi principle, wastewater under pressure flowing from the passage 55' through the cone 81, causes a drop in static pressure at the outlet of the cone which creates a suction effect sufficient to facilitate air distribution from the passage 65' via the air-feed pipe 77, so that this air mixes with the wastewater. Air can be fed under pressure or drawn in by granity.

In both embodiments the first and second pipes are parallel while the nipple(s), the transverse bar section of the T-shaped pipe, the nozzle and the air-feed pipe extend normal to these first and second pipes.

In both embodiments also, the first and second pipes and their respective nipples are molded in F.R.P. material. The other components however are made of conventional, injected plastic material known to be particularly resistant to abrasion such as polyurethane. The invention is not restricted however to the use of such materials, exclusively. Indeed, all the components could be made of F.R.P. if desired.

In both embodiments, all of the structural components can easily be premolded, to provide precise alignment. All the components are provided with premolded sockets to make their assembly easy to carry out by mere fitting. All the internal surfaces of the passages, including the connection between nipples and the main pipe, can be easily finished and inspected. Indeed, the "modular" structure of the header provides suitable access to allow good internal surfacing and inspection. Then, the plastic injected components may be chemically bonded to the F.R.P. nipples once they have been preassembled. The water pipe and air-pipe may however be mounted separately to a custom made frame.

The embodiments of the invention in which an exclusive property or privilege is claimed are defined as follows:

1. In a jet aeration and mixing header for use in a water or wastewater treatment system, said header comprising:

a first pipe defining a cylindrical water passage, a second pipe extending parallel to the first pipe and defining a cylindrical air passage;

at least one water outlet conduit connected to said first pipe and laterally extending therefrom to allow water to be expelled out of said water passage;

at least one air-feed pipe, each air-feed pipe connecting the second pipe to one of said at least one outlet conduit at a given point of connection along said one outlet conduit to allow air to be delivered from said air passage into said water flowing through said one outlet conduit; and a venturi cone mounted in each outlet conduit, said cone having a wide inlet extending across the outlet conduit upstream said point of connection of the air-feed pipe, and a narrow outlet extending centrally in said outlet conduit downstream said point of connection to allow, in use, air to be drawn from the air passage and mixed with the water expelled through the narrow outlet of said cone; the improvements wherein:

said first pipe is provided with at least one hollow, long radius nipple laterally projecting therefrom, each nipple having a large, flared inlet that opens into said water passage, and a small outlet for use to connect one of said at least one water outlet conduit, each nipple being solidly connected to said first pipe with no sharp edges or protusions left inside said water passage that would favor fibrous materials to attach, accumulate and clog said nipple inlet;

each water outlet conduit is defined by a T-shaped pipe having a stem section and a transverse bar section, said transverse bar section being connected at one end to the small outlet of one of said at least one nipple to form said outlet conduit with said stem section acting as said point of connection for the air-feed pipe connected to said outlet conduit;

the wide inlet of each venturi cone has an internal diameter identical to the diameter of the small outlet of the nipple adjacent thereto, and each venturi cone is mounted into the transverse bar section of the T-shaped pipe forming said outlet conduit so that the wide inlet of said venturi cone is adjacent the small outlet of the nipple to which said outlet conduit is connected.

2. The improved header of claim 1, further comprising a nozzle connected to each transverse bar section defining one of said at least one outlet conduit, opposite to the one end of said transverse bar section connected to said nipple, said nozzle having an inlet having an internal diameter identical to the diameter of said transverse bar, and an outlet of smaller diameter.

3. The improved header of claim 2, further comprising sockets integral to at least one of said nipple, T-shaped pipe, air-feed pipe, venturi cone and/or nozzle to interconnect all of these elements by mere fitting.

4. The improved header of claim 3, wherein said first pipe has a plurality of nipples solid thereto and a plurality of water outlet conduits and air-feed pipes connected to said nipples.

5. The improved header of claim 4, wherein said first pipe, said nipples solid to said first pipe and said second pipe are all made of fiber reinforced plastic material and wherein all the other structural elements of the header are made of injected plastic material.

6. The improved header of claim 5, wherein said nipples are sized to allow insertion of at least one hand therein through their small outlets in order to give easy access and thus provide physical inspection facility to said first and second pipes through said nipples.

7. The improved header of claim 3, in the form of a single air jet module, wherein:

said first pipe is short in length and has a single nipple solid thereto and a single outlet conduit connected to said single nipple;

said first pipe has ends provided with sockets sized to receive and fit over lengths of wastewater pipes; and said second pipe is also short in length and also has ends provided with sockets sized to receive and fit over lengths of air pipes.

8. The improved header of claim 7, wherein said first pipe, the single nipple solid thereto and said second pipe are made of fiber reinforced plastic material and all the other structural elements of the header are made of injected plastic material.

* * * * *